US010061236B2

(12) United States Patent
Haseba et al.

(10) Patent No.: US 10,061,236 B2
(45) Date of Patent: Aug. 28, 2018

(54) FIXING DEVICE AND IMAGE FORMING APPARATUS

(71) Applicant: FUJI XEROX Co., Ltd., Tokyo (JP)

(72) Inventors: Shigehiko Haseba, Kanagawa (JP); Yasutaka Naito, Kanagawa (JP); Takayuki Uchiyama, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 5 days.

(21) Appl. No.: 15/446,158

(22) Filed: Mar. 1, 2017

(65) Prior Publication Data

US 2018/0081306 A1 Mar. 22, 2018

(30) Foreign Application Priority Data

Sep. 21, 2016 (JP) ..... 2016-184018

(51) Int. Cl.
*G03G 15/20* (2006.01)

(52) U.S. Cl.
CPC ..... *G03G 15/2039* (2013.01)

(58) Field of Classification Search
USPC ..... 399/38, 67–69, 122
See application file for complete search history.

(56) References Cited

U.S. PATENT DOCUMENTS 7,280,775 B2 * 10/2007 Kubochi ..... G03G 15/2039 374/141

FOREIGN PATENT DOCUMENTS

JP 58-153956 A 9/1983

* cited by examiner

*Primary Examiner* — Hoan Tran
(74) *Attorney, Agent, or Firm* — Sughrue Mion, PLLC

(57) ABSTRACT

A fixing device includes a fixing unit that heats and fixes an unfixed image held on a recording medium onto the recording medium, a detector that is disposed at a position downstream from the fixing unit in a direction in which the recording medium is transported and that detects the recording medium by detecting thermal energy emitted by the recording medium, and a heating unit that heats the detector.

10 Claims, 9 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2016-184018 filed Sep. 21, 2016.

BACKGROUND

(i) Technical Field

The present invention relates to a fixing device and an image forming apparatus.

(ii) Related Art

In the related art, there is a fixing device that performs a fixing treatment on a recording sheet holding an unfixed toner image thereon by causing the recording sheet to pass a nip defined between a rotating body for heating and a rotating body for applying pressure, which are pressed into contact with each other, so as to heat the unfixed toner image.

SUMMARY

According to an aspect of the invention, there is provided a fixing device including a fixing unit that heats and fixes an unfixed image held on a recording medium onto the recording medium, a detector that is disposed at a position downstream from the fixing unit in a direction in which the recording medium is transported and that detects the recording medium by detecting thermal energy emitted by the recording medium, and a heating unit that heats the detector.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

Exemplary Embodiment

Figure 1:
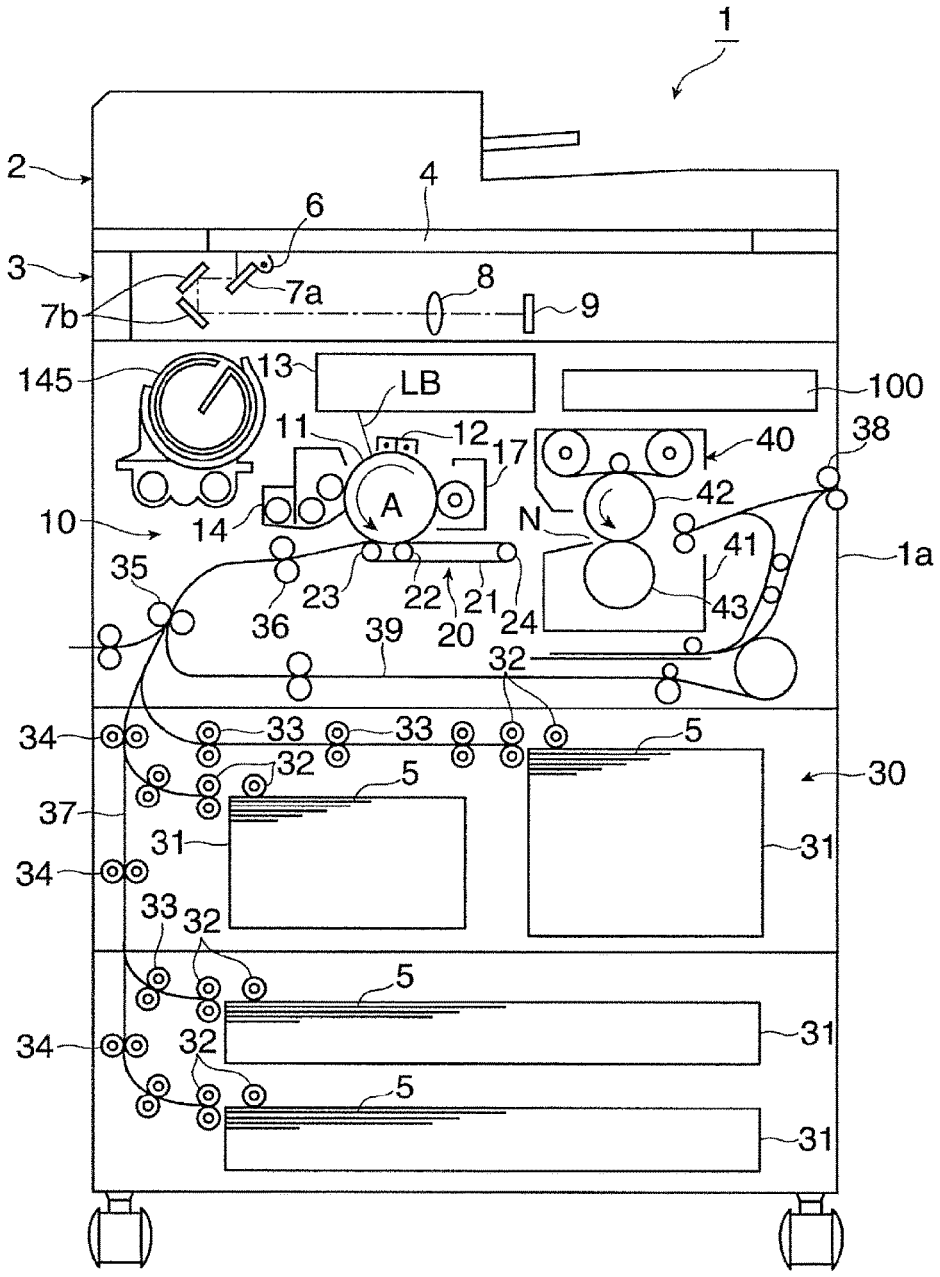
FIG. 1 is a schematic diagram illustrating an image forming apparatus that employs a fixing device according to an exemplary embodiment of the present invention.
Figure 2:
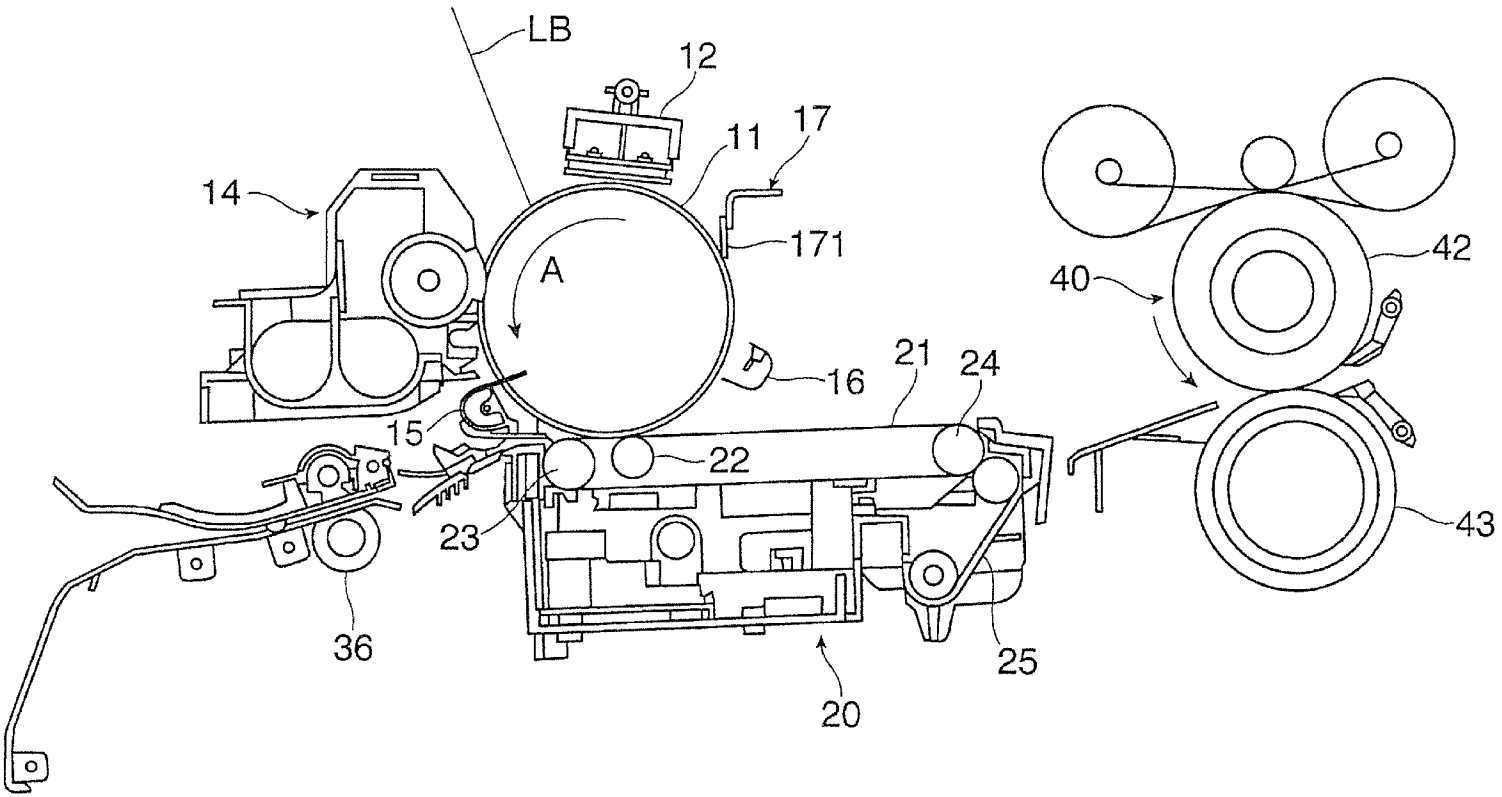
FIG. 2 is a diagram illustrating an image forming section of the image forming apparatus according to the present exemplary embodiment.

FIG. 1 and FIG. 2 illustrate an image forming apparatus that employs a fixing device according to the present exemplary embodiment. FIG. 1 schematically illustrates an overall view of the image forming apparatus, and FIG. 2 is an enlarged view of a principal portion (including an image forming device and the like) of the image forming apparatus.

<Overall Configuration of Image Forming Apparatus>

An image forming apparatus 1 according to the present exemplary embodiment is, for example, a monochromatic image forming apparatus that employs an electrophotographic system. The image forming apparatus 1 includes an automatic document transport device 2 that automatically transports a document (not illustrated) to a reading position and an image reading device 3 that reads an image of the document (not illustrated) on a document placement glass 4, and the automatic document transport device 2 and the image reading device 3 are located above an apparatus body 1*a*.

The image reading device 3 reads an image of a document (not illustrated), which is transported by the automatic document transport device 2 in such a manner as to pass through the reading position of the document placement glass 4 or which is placed on the document placement glass 4, by causing a light source 6 to illuminate the image of the document (not illustrated) and causing an imaging lens 8 to focus the light reflected by the document (not illustrated) on an image reading element 9 via a full-rate mirror 7*a* and half-rate mirrors 7*b* so as to form an optical image.

The image forming apparatus 1 includes an image forming device 10, which is an example of an image forming unit that forms a toner image developed with a toner included in a developer, a transfer device 20 that transfers a toner image formed by the image forming device 10 onto one of recording sheets 5, each of which is an example of a recording medium, a sheet-feeding device 30 that accommodates and transports the recording sheets 5, each of which is to be fed to a transfer position in the transfer device 20, and a fixing device 40 according to the present exemplary embodiment that fixes a toner image, which has been transferred to one of the recording sheets 5 by the transfer device 20, onto the recording sheet 5.

As illustrated in FIG. 1, the image forming device 10 includes a rotatable photoconductor drum 11, which is an example of an image carrier, and the following devices, each of which is an example of a toner-image forming unit, are disposed around the photoconductor drum 11: a charging device 12 that charges, to a certain electric potential, a circumferential surface (image-holding surface) of the photoconductor drum 11 on which an image may be formed, an exposure device 13, which is an example of an electrostatic-latent-image forming unit that radiates light based on image information (signal) onto the charged circumferential surface of the photoconductor drum 11 in such a manner as to form electrostatic latent images (of different colors) having electric potential differences, a developing device 14, which is an example of a developing unit that develops the electrostatic latent images into toner images with toners included in developers, a pre-transfer charging device 15 (see FIG. 2) that causes a toner image developed on the circumferential surface of the photoconductor drum 11 to have a certain electric charge before a transfer process is performed, a transfer device 20 that is an example of a transfer unit and that transfers the toner image onto one of the recording sheets 5, a pre-cleaning charging device 16 (see FIG. 2) that causes the circumferential surface of the photoconductor drum 11 to have a certain electric charge and removes the electric charge from the circumferential surface of the photoconductor drum 11 before cleaning the circumferential surface of the photoconductor drum 11, a drum-cleaning device 17 that cleans the image-holding surface of the photoconductor drum 11 by removing attached substances such as residual toner deposited on the image-holding surface of the photoconductor drum 11 from which the electric charge has been removed by the pre-cleaning charging device 16, and the like.

The photoconductor drum 11 is obtained by forming the image-holding surface that has a photoconductive layer (photosensitive layer) made of a photosensitive material over the circumferential surface of a base member that is grounded and that has a cylindrical shape or a columnar shape. The photoconductor drum 11 is supported in such a manner as to rotate in the direction of arrow A as a result of power being supplied thereto from a driving device (not illustrated).

The charging device 12 is formed of a non-contact charging device such as a scorotron that is disposed so as not to be in contact with the surface of the photoconductor drum 11. A charging voltage is applied to the charging device 12. In the case where the developing device 14 performs reversal development, a voltage or a current having a polarity that is the same as the charge polarity of the toner supplied by the developing device 14 is applied or supplied to the charging device 12 as the charging voltage. Note that a contact-type charging device such as a contact-type charging roller that is disposed in such a manner as to be in contact with the photoconductor drum 11 may be used as the charging device 12.

The exposure device 13 radiates a light beam LB based on image information of a document (not illustrated) read by the image reading device 3 or image information input to the image forming apparatus 1 onto the circumferential surface of the photoconductor drum 11, which has been charged, so as to form an electrostatic latent image. When forming a latent image, image information (signal) that has undergone image processing performed by an image processing unit after being read by the image reading device 3 or after being input to the image forming apparatus 1 by using a suitable unit is transmitted to the exposure device 13.

In the developing device 14, a developing roller that holds the developer and transports the developer to a development region facing the photoconductor drum 11, stirring transport members such as two screw augers that transport the developer while stirring the developer such that the developer passes through the developing roller, a layer-thickness control member that controls the amount (layer thickness) of the developer that is held by the developing roller, and the like are disposed in a housing, in which an opening and a developer containing chamber are formed. In the developing device 14, a developing bias voltage is applied between the developing roller and the photoconductor drum 11 by a power supply unit (not illustrated). As the developer, a two-component developer including a non-magnetic toner and a magnetic carrier is used.

As illustrated in FIG. 2, the pre-transfer charging device 15 is formed of a non-contact charging device such as a corotron that is disposed so as not to be in contact with the surface of the photoconductor drum 11 before the transfer process is performed. A charging voltage is applied to the pre-transfer charging device 15. For example, a voltage or a current having a polarity that is the same as the charge polarity of the toner is applied or supplied to the pre-transfer charging device 15 as the charging voltage.

As illustrated in FIG. 2, the transfer device 20 is a contact-type transfer device including a transfer roller 22 that rotates while being in contact with the circumferential surface of the photoconductor drum 11 with a transfer belt 21 interposed therebetween and to which a transfer voltage is applied. As the transfer voltage, a direct-current voltage having a polarity opposite to the charge polarity of the toner is applied by a power supply unit (not illustrated). The transfer device 20 includes the transfer belt 21 that rotates and passes through the transfer position located between the photoconductor drum 11 and the transfer roller 22, belt-support rollers 23 and 24 that maintain the transfer belt 21 in a desired state from a space enclosed by the transfer belt 21 while rotatably supporting the transfer belt 21, the transfer roller 22, which is an example of a transfer unit that is disposed so as to face the inner surface (rear surface) of the transfer belt 21 and that transfers a toner image on the photoconductor drum 11 onto one of the recording sheets 5, and a belt cleaning device 25 that cleans the outer surface of the transfer belt 21 by removing attached substances such as residual toner and paper dust deposited on the outer surface of the transfer belt 21 after the transfer belt 21 has passed through the transfer roller 22.

For example, an endless belt made of a material obtained by dispersing a resistance-adjusting agent, such as carbon black, or the like in a synthetic resin, such as a polyimide resin or a polyamide resin, is used as the transfer belt 21. The belt-support roller 23 serves as a tension-applying roller that exerts tension on the transfer belt 21, and the belt-support roller 24 serves as a driving roller that is driven by a driving device (not illustrated) so as to rotate.

The pre-cleaning charging device 16 is formed of a non-contact charging device such as a corotron that is disposed so as not to be in contact with the surface of the photoconductor drum 11, which has performed the transfer process. A charging voltage is applied to the pre-cleaning charging device 16. For example, a voltage or a current having a polarity opposite to the charge polarity of the toner is applied or supplied to the pre-cleaning charging device 16 as the charging voltage.

The drum-cleaning device 17 includes a container body that is partially open, a cleaning plate 171 that is disposed in such a manner as to be brought into contact with the circumferential surface of the photoconductor drum 11 at a predetermined pressure after the transfer process has been performed and that cleans the circumferential surface of the photoconductor drum 11 by removing attached substances, such as residual toner, and a delivery member such as a screw auger that collects and transports attached substances such as a toner removed by the cleaning plate 171 such that the attached substances are sent out to a collecting system (not illustrated).

As illustrated in FIG. 1, the fixing device 40 includes a roll-shaped or belt-shaped rotating body 42 for heating (hereinafter referred to as heating-rotating body 42) that rotates in a direction indicated by an arrow and that is heated by a heating unit in such a manner that the surface temperature thereof is maintained at a predetermined temperature and a roll-shaped or belt-shaped rotating body 43 for applying pressure (hereinafter referred to as pressurizing-rotating body 43) that rotates while being in contact with the heating-rotating body 42 at a predetermined pressure and being approximately parallel to the axial direction of the heating-rotating body 42. The heating-rotating body 42 and the pressurizing-rotating body 43 are disposed in a housing 41 in which the introduction port and the ejection port for the recording sheets 5 are formed. In the fixing device 40, a portion where the heating-rotating body 42 and the pressurizing-rotating body 43 are in contact with each other functions as a fixing treatment portion (nip) N where necessary fixing treatments (heating and applying pressure) are performed. Note that the configuration of the fixing device 40 will be described in detail later.

The sheet-feeding device 30 is positioned below the transfer device 20 in the vertical direction. The sheet-feeding device 30 includes one or more sheet-accommodating units 31, in each of which a desired type of the recording sheets 5 each having a desired size and the like are accommodated in a state of being stacked on top of one another, and delivery units 32 that send out the recording sheets 5 one by one from the one or more sheet-accommodating units 31. For example, the one or more sheet-accommodating units 31 are mounted by using guide rails (not illustrated) in such a manner as to be capable of being drawn out toward the front surface (side surface that faces a user during an operation) of the image forming apparatus 1.

Examples of the recording sheets 5 include normal sheets, thin paper, such as tracing paper, and OHP sheets that are used in a copying machine, a printer, and the like that employ an electrophotographic system. In order to further improve the smoothness of surfaces of images that have been fixed to the recording sheets 5, surfaces of the recording sheets 5 may also be as smooth as possible, and thus, for example, coated sheets, which are obtained by coating surfaces of normal sheets with a resin or the like, so-called thick paper such as art paper for printing whose basis weight is relatively large, and the like may also be used.

As illustrated in FIG. 1, a sheet-feeding transport path 37 is disposed between the sheet-feeding device 30 and the transfer device 20. The sheet-feeding transport path 37 includes one or more pairs of sheet-transport rollers 33 to 36 and a transport guide (not illustrated) that transport the recording sheets 5 sent from the sheet-feeding device 30 to a second transfer position. In the sheet-feeding transport path 37, the pair of sheet-transport rollers 36, which are disposed at a position immediately in front of the second transfer position, serve as, for example, rollers (registration rollers) that adjust the timing of transportation of one of the recording sheets 5. A pair of sheet-ejection rollers 38 is disposed at a position near the ejection port for the recording sheets 5, which is formed in the apparatus body 1*a* of the image forming apparatus 1. The pair of sheet-ejection rollers 38 eject one of the recording sheets 5 that is sent out from the fixing device 40 after a toner image has been fixed to the recording sheet 5 to a sheet-ejection section (not illustrated) that is mounted on a side surface of the image forming apparatus 1.

A two-sided printing transport path 39 is disposed below the pair of sheet-ejection rollers 38. The two-sided printing transport path 39 is used for flipping over one of the recording sheets 5 having a toner image formed on one surface thereof and transporting the recording sheet 5 to the transfer device 20 again so as to form an image on the rear surface of the recording sheet 5.

In FIG. 1, a reference numeral 100 denotes a control device that integrally controls the operation of the image forming apparatus 1. Although not illustrated, the control device 100 includes a central processing unit (CPU), a read only memory (ROM), a random access memory (RAM), a bus connecting the CPU, the ROM, and the like to one another, and a communication interface.

In FIG. 1, a reference numeral 145 denotes a toner cartridge that is disposed in such a manner as to extend in a direction perpendicular to FIG. 1 and that contains a developer that is to be supplied to the developing device 14 and that includes at least a toner.

<Operation of Image Forming Apparatus>

A basic image forming operation performed by the image forming apparatus 1 will now be described below.

Once the image forming apparatus 1 has received command information of a request for a monochromatic image forming operation (printing) from a user interface, a printer driver, or the like, which is not illustrated, the image forming device 10, the transfer device 20, the fixing device 40, and the like are activated.

In the image forming device 10, first, the photoconductor drum 11 rotates in the direction of arrow A as illustrated in FIG. 1, and the surface of the photoconductor drum 11 is charged by the charging device 12 in such a manner as to have a predetermined polarity (negative polarity in the present exemplary embodiment) and a predetermined electric potential. Next, the exposure device 13 radiates the light beam LB, which is emitted on the basis of an image of a document (not illustrated) read by the image reading device 3 or an image signal input to the image forming apparatus 1, onto the charged surface of the photoconductor drum 11 and forms an electrostatic latent image having a certain potential difference on the surface of the photoconductor drum 11.

Subsequently, the image forming device 10 develops the electrostatic latent image formed on the photoconductor drum 11 by causing the developing roller to supply a toner that has been charged so as to have a predetermined polarity (negative polarity) and electrostatically depositing the toner onto the electrostatic latent image. The electrostatic latent image formed on the photoconductor drum 11 is developed into a visible toner image with a black toner through the above developing process.

Then, after the toner image, which has been formed on the photoconductor drum 11 of the image forming device 10, has been transported to the transfer position, the transfer device 20 transfers the toner image onto one of the recording sheets 5 that is transported by the transfer belt 21 of the transfer device 20.

After the toner image has been transferred to the recording sheet 5, in the image forming device 10, the drum-cleaning device 17 removes attached substances on the surface of the photoconductor drum 11 by scraping off the attached substances so as to clean the surface of the photoconductor drum 11. As a result, the image forming device 10 is brought into a ready state for the next image forming operation.

In the sheet-feeding device 30, one of the recording sheets 5 is sent out to the sheet-feeding transport path 37 in accordance with the timing at which an image forming operation is performed. In the sheet-feeding transport path 37, the pair of sheet-transport rollers 36 serving as registration rollers send out the recording sheet 5 to the transfer belt 21 of the transfer device 20 in accordance with the timing at which the toner image is transferred onto the recording sheet 5.

In the transfer position, the transfer roller 22 of the transfer device 20 transfers the toner image formed on the photoconductor drum 11 onto the recording sheet 5, which is transported by the transfer belt 21.

After that, the recording sheet 5, to which the toner image has been transferred, is transported to the fixing device 40 by the transfer belt 21. In the fixing device 40, the recording sheet 5, to which the toner image has been transferred, is introduced into the nip N defined between the heating-rotating body 42, which rotates, and the pressurizing-rotating body 43 and so as to pass through the nip N. As a result, the necessary fixing treatments (heating and applying pressure) are performed on the recording sheet 5, and the unfixed toner image is fixed onto the recording sheet 5. Finally, in the case of performing an image forming operation for forming an image on only one surface of the recording sheet 5, the recording sheet 5, to which the toner image has been fixed, is ejected to the sheet-ejection section (not illustrated), which is mounted on the side surface of the image forming apparatus 1, by the pair of sheet-ejection rollers 38.

In the case of forming an image on the two surfaces of one of the recording sheets 5, the recording sheet 5 having a toner image formed on one surface thereof is flipped over and transported to the transfer device 20 again via the two-sided printing transport path 39 instead of being ejected to the sheet-ejection section (not illustrated), and a toner image is transferred onto the rear surface of the recording sheet 5. The recording sheet 5 having the toner image transferred to the rear surface thereof is transported to the fixing device 40 by the transfer belt 21, and the fixing treatments (heating and applying pressure) are performed on the recording sheet 5 by the fixing device 40. Then, the recording sheet 5 is ejected to the sheet-ejection section (not illustrated), which is mounted on the side surface of the image forming apparatus 1, by the pair of sheet-ejection rollers 38.

As a result of performing the above operations, the recording sheet 5 on which a monochromatic image has been formed is output.

<Configuration of Fixing Device>

Figure 3:
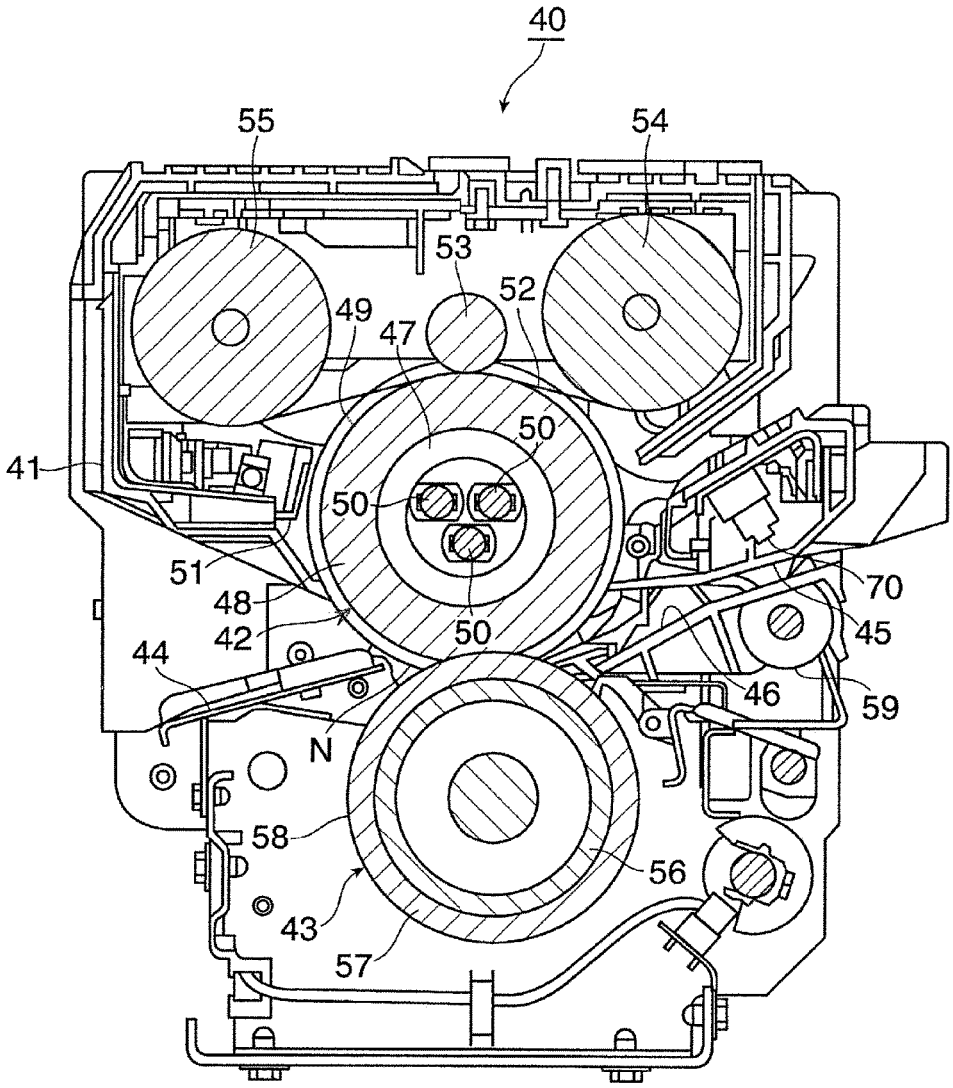
FIG. 3 is a cross-sectional view of the fixing device according to the present exemplary embodiment.

FIG. 3 is a cross-sectional view of the fixing device 40 according to the present exemplary embodiment.

As illustrated in FIG. 3, the fixing device 40 includes the housing 41 formed of a box body that has a substantially rectangular parallelepiped shape and that has an introduction port and an ejection port for the recording sheets 5. An entry-guide plate 44 having a flat plate-like shape is disposed in the introduction port of the housing 41, and the entry-guide plate 44 guides one of the recording sheets 5, which has been transported by the transfer belt 21 and separated from the transfer belt 21, to the nip N defined between the heating roller 42 and the pressure roller 43, which are pressed into contact with each other. In addition, a pair of exit-guide members 45 and 46 are disposed in the ejection port of the housing 41, and the pair of exit-guide members 45 and 46 face each other in the vertical direction in such a manner as to guide one of the recording sheets 5 that has undergone the fixing treatment at the nip N defined between the heating roller 42 and the pressure roller 43, which are pressed into contact with each other.

In the housing 41 of the fixing device 40, the heating roller 42, which is an example of a rotating body for heating, and the pressure roller 43, which is an example of a rotating body for applying pressure, are provided as a pair of rotating bodies that form the nip N by being pressed into contact with each other. As will be described later, the heating roller 42 and the pressure roller 43 are arranged in such a manner that their states may be switched between a press-contacted state in which the heating roller 42 and the pressure roller 43 are pressed into contact with each other at a predetermined pressure and a separated state in which the heating roller 42 and the pressure roller 43 are separated from each other. The heating roller 42 includes a core bar 47 that is made of a metal, such as a stainless steel alloy or an aluminum alloy, and that has a cylindrical shape, a heat-resistant elastic body layer 48 that is made of a heat-resistant silicone rubber or the like and that coats a surface of the core bar 47 in such a manner as to have a large thickness, and a release layer 49 that is made of tetrafluoroethylene, polytetrafluoroethylene perfluoroalkoxyethylene copolymer (PFA), or the like and that coats a surface of the heat-resistant elastic body layer 48. Three halogen lamps 50 are disposed as heating sources in the heating roller 42. The heating roller 42 is heated by the halogen lamps 50 disposed therein. In addition, the surface temperature of the heating roller 42 is detected by a temperature sensor 51, and energization of the halogen lamps 50 is controlled by a controller (not illustrated) in such a manner that the surface temperature of the heating roller 42 is equal to a predetermined fixing-treatment temperature.

A cleaning web 52 that is formed of a piece of nonwoven fabric or the like and that removes foreign objects such as a toner deposited on a surface of the heating roller 42 has been brought into contact with the surface of the heating roller 42 by a cleaning roller 53. The cleaning web 52 is fed by a web feeding roller 54 and wound up by a web winding roller 55 at a predetermined timing.

The pressure roller 43 includes a core bar 56 that is made of a metal, such as a stainless steel alloy or an aluminum alloy, and that has a cylindrical shape and a central shaft, a heat-resistant elastic body layer 57 that is made of a heat-resistant silicone rubber or the like and that coats a surface of the core bar 56 in such a manner as to have a thickness smaller than that of the heat-resistant elastic body layer 48 of the heating roller 42, and a release layer 58 that is made of tetrafluoroethylene, PFA, or the like and that coats a surface of the heat-resistant elastic body layer 57.

Figure 4:
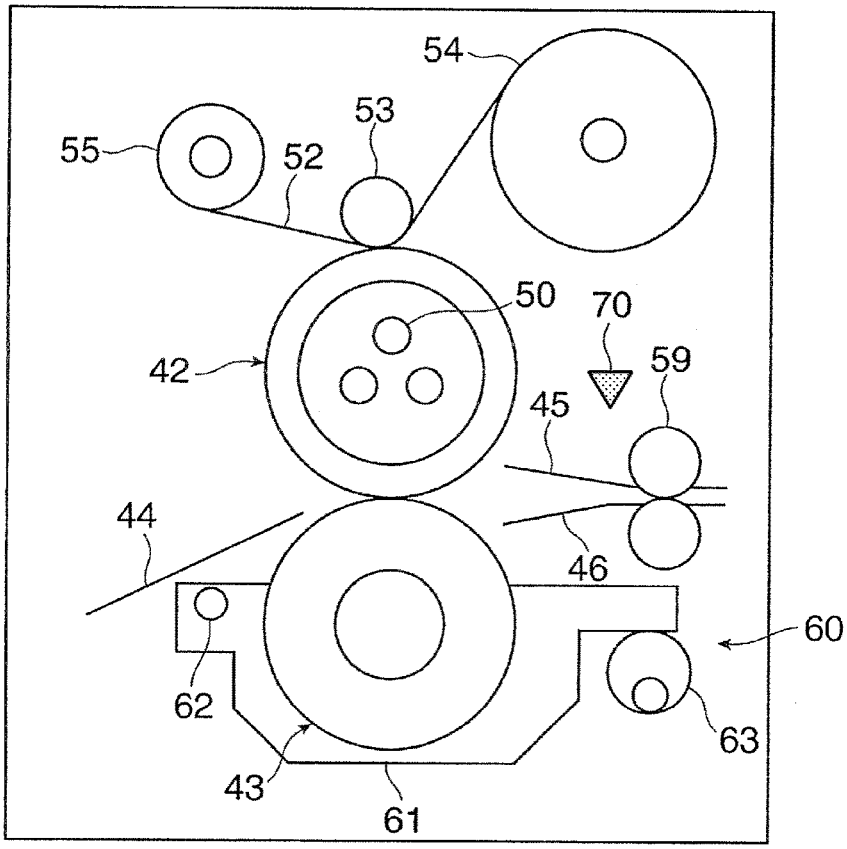
FIG. 4 is a schematic diagram illustrating the fixing device.

As schematically illustrated in FIG. 4, the fixing device 40 includes a nip releasing mechanism 60 serving as a contact/separation unit that performs an operation for causing the pressure roller 43 to be pressed into contact with the heating roller 42 and an operation for causing the pressure roller 43 to be separated from the heating roller 42. As illustrated in FIG. 3, the heating roller 42 is driven by a driving unit (not illustrated) so as to rotate while the position of the heating roller 42 is fixed with respect to the housing 41 of the fixing device 40. As illustrated in FIG. 4, the pressure roller 43 is rotatably attached to a swing arm 61 of the nip releasing mechanism 60. The swing arm 61 is supported by the housing 41 of the fixing device 40 in such a manner as to be rotatable around a fulcrum 62. An eccentric cam 63 is disposed at an end portion of the swing arm 61 and moves the pressure roller 43 in a direction in which the pressure roller 43 is pressed into contact with the heating roller 42 and in a direction in which the pressure roller 43 is separated from the heating roller 42. The swing arm 61 is capable of moving in a pressing direction, in which the pressure roller 43 is pressed into contact with the heating roller 42, and in a separation direction, in which the pressure roller 43 is separated from the heating roller 42, as a result of the eccentric cam 63 being driven by a driving unit (not illustrated) so as to rotate. Note that the pressure roller 43 is pressed into contact with the heating roller 42 by an urging force of an urging unit (not illustrated) such as a coil spring that is attached to the swing arm 61.

As illustrated in FIG. 3, a pair of ejection rollers 59 are disposed in the ejection port of the fixing device 40, and the pair of ejection rollers 59 eject, from the fixing device 40, one of the recording sheets 5 to which a toner image has been fixed as a result of the recording sheet 5 passing through the nip N defined between the heating roller 42 and the pressure roller 43, which are pressed into contact with each other.

In addition, in the ejection port of the fixing device 40, an infrared sensor 70 that is an example of a non-contact detector that detects one of the recording sheets 5 is disposed at a position corresponding to the ejection rollers 59, which transport one of the recording sheets 5 while controlling the position of the recording sheet 5. In the ejection port of the fixing device 40, the infrared sensor 70 is disposed above the upper exit-guide member 45 in such a manner as to directly face one of the recording sheets 5 through an opening formed in the upper exit-guide member 45. The infrared sensor 70 receives light in the infrared region (infrared rays) that is thermal energy emitted by the recording sheet 5, which is a medium to be detected, and converts the light into an electrical signal in such a manner as to detect the recording sheet 5, to which a toner image has been heated and fixed by the fixing device 40, while not being in contact with the recording sheet 5. Infrared sensors may be broadly divided into quantum-type infrared sensors and thermal-type infrared sensors in accordance with the principle of operation thereof. In the present exemplary embodiment, a thermal-type infrared sensor is employed as the infrared sensor 70. For example, an infrared reflective sensor (product number PS122TL4-A) manufactured by KODENSHI CORP. is used as the infrared sensor 70. However, it is obvious that the infrared sensor 70 is not limited to this sensor, and that a different type of infrared sensor may be used.

Figure 5:
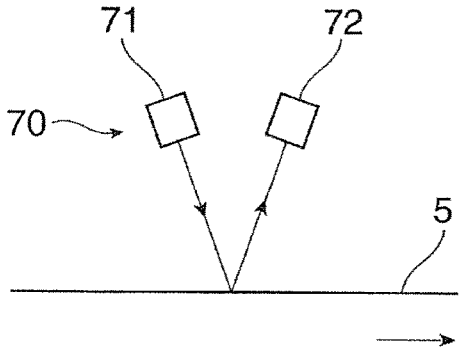
FIG. 5 is a schematic diagram illustrating an infrared sensor.

As illustrated in FIG. 5, the infrared sensor 70 detects one of the recording sheets 5, which is a medium to be detected, by radiating infrared rays onto the recording sheet 5 by using an light-emitting device 71, which is formed of a light-emitting diode (LED) or the like, and by receiving the infrared rays reflected by the recording sheet 5 by using a light-receiving device 72, which is formed of a phototransistor or the like having sensitivity to the infrared region.

Figure 6A:
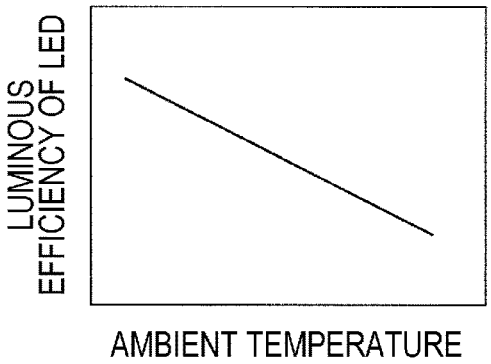
FIGS. 6A to 6C are graphs representing characteristics of the infrared sensor.
Figure 6B:
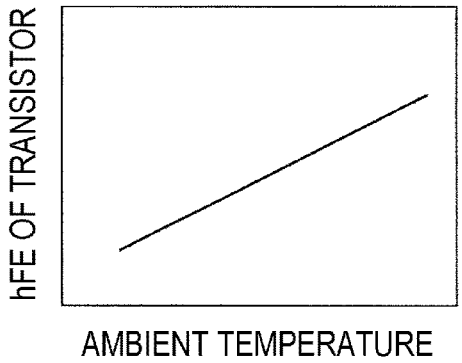
Figure 6C:
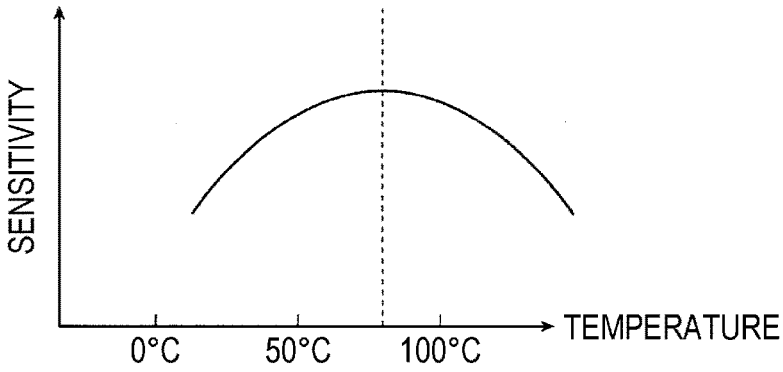

As illustrated in FIG. 6A, the light-emitting device 71, which is formed of an LED or the like and which is included in the infrared sensor 70, has a negative temperature characteristic that causes the luminous efficiency of the light-emitting device 71 to be decreased when the ambient (environmental) temperature increases. As illustrated in FIG. 6B, the light-receiving device 72, which is formed of a phototransistor or the like and which is included in the infrared sensor 70, has a positive temperature characteristic that causes the current amplification factor ($h_{FE}$) of the phototransistor to increase when the ambient temperature increases. Thus, the infrared sensor 70 including the light-emitting device 71 and the light-receiving device 72, which have the above-mentioned temperature characteristics, has a temperature characteristic that forms a substantially mountain-like shape as illustrated in FIG. 6C. With this temperature characteristic, the detection sensitivity of the infrared sensor 70 is low when the ambient temperature is low, and the detection sensitivity of the infrared sensor 70 increases and reaches its peak as the ambient temperature increases. Then, when the ambient temperature further increases, the detection sensitivity of the infrared sensor 70 decreases.

Images that are to be fixed onto the recording sheets 5 may be broadly divided into images each of which is formed of a character, a straight line, or the like and each of which has a low area ratio such that the image may be considered as a substantially blank sheet, and images each of which is formed of a photographic image, a graphic image, or the like and each of which has a relatively high area ratio such that the image may be considered as a substantially solid image.

There may be a case where the fixing device 40 is in a low-temperature state and a case where the fixing device 40 is in a high-temperature state. In the low-temperature state, the temperature of the infrared sensor 70 is approximately equal to the environmental temperature and is lower than a predetermined threshold temperature. For example, the fixing device 40 is in the low-temperature state in an early morning in winter in the case where the image forming apparatus 1 has not been switched on or in the case where the image forming apparatus 1 has not operated for a long period of time. In the high-temperature state, the infrared sensor 70 has been heated by heat that has been transferred to the infrared sensor 70 from the fixing device 40, radiant heat that has been received by the infrared sensor 70 from the fixing device 40, and the like in such a manner that the temperature of the infrared sensor 70 is higher than the predetermined threshold temperature. For example, the fixing device 40 is brought into the high-temperature state when an image forming operation is started in the image forming apparatus 1.

Figure 7:
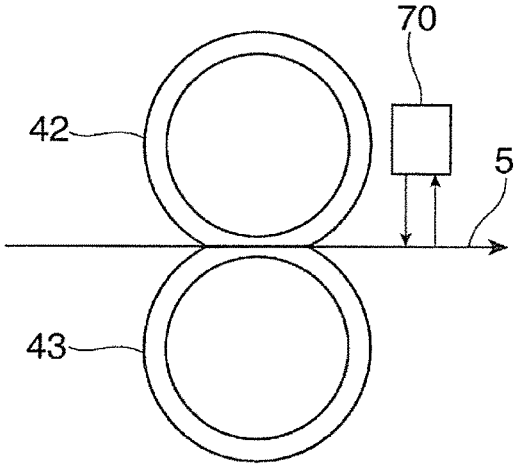
FIG. 7 is a schematic diagram illustrating the positional relationship between the infrared sensor and a recording sheet.
Figure 8:
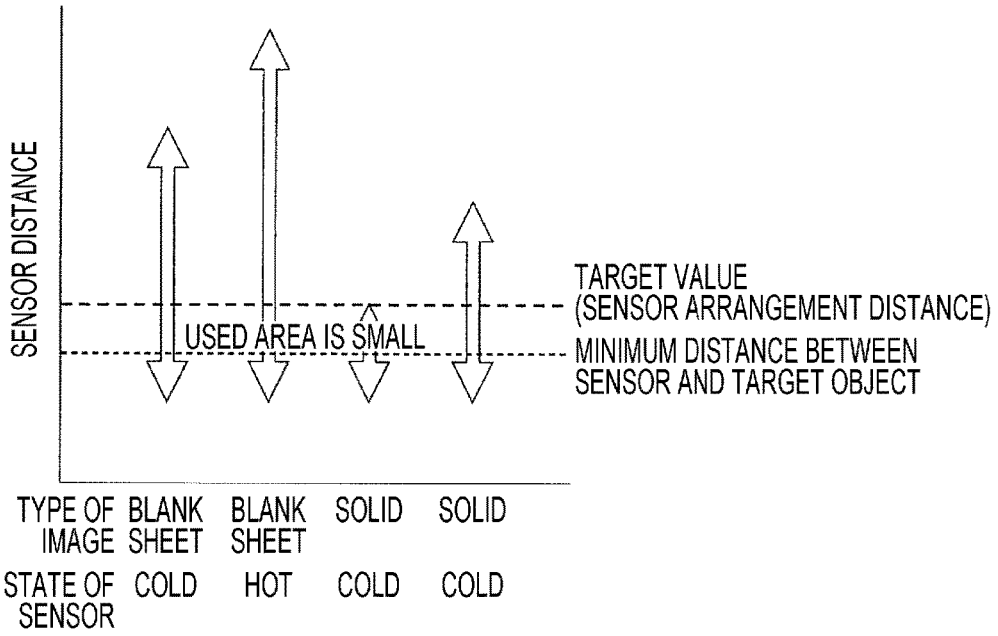
FIG. 8 is a graph representing the characteristics of the infrared sensor.

Since the infrared sensor 70 has a temperature characteristic such as that illustrated in FIG. 6C, it has been found from the research conducted by the inventors of the present invention that the infrared sensor 70 has a characteristic such as that illustrated in FIG. 8. In FIG. 8, the vertical axis denotes the distance between one of the recording sheets 5 and the light-receiving device 72 of the infrared sensor 70 illustrated in FIG. 7, and the horizontal axis denotes the type of an image to be fixed onto the recording sheet 5 and the temperature state of the infrared sensor 70.

That is to say, as illustrated in FIG. 8, in the case where the type of the image is a blank sheet, which has a high reflectance with respect to infrared rays, the distance in which the infrared sensor 70 is capable of detecting the recording sheet 5 is large, and the infrared sensor 70 may detect the existence of the recording sheet 5 with certainty regardless of whether the temperature state of the infrared sensor 70 is a low temperature (COLD) or a high temperature (HOT). In addition, even in the case where the type of the image is a black solid image, which has a relatively low reflectance with respect to infrared rays, when the temperature state of the infrared sensor 70 may be considered as a high temperature, the distance in which the infrared sensor 70 is capable of detecting the recording sheet 5 is reasonably large, and the infrared sensor 70 may detect the existence of the recording sheet 5 with certainty.

In contrast, in the case where the type of the image is a black solid image, which has a relatively low reflectance with respect to infrared rays, and where the temperature state of the infrared sensor 70 is a low temperature, the distance in which the infrared sensor 70 is capable of detecting the recording sheet 5 is markedly decreased, and there is a possibility that a false detection will occur when the infrared sensor 70 detects the recording sheet 5, that is, it may be difficult for the infrared sensor 70 to detect the recording sheet 5 passing therethrough.

Accordingly, in the present exemplary embodiment, a heating unit that heats the infrared sensor 70 before the fixing device 40 starts performing a fixing operation is provided. As the heating unit, an additional heat-generating device that generates heat by being energized and heats the infrared sensor 70 may be provided. However, in this case, since it is necessary to provide an additional heat-generating device, the number of components and power consumption increase. Therefore, in the present exemplary embodiment, the infrared sensor 70 is configured to be heated by using heat emitted by the heating roller 42 of the fixing device 40.

Figure 9:
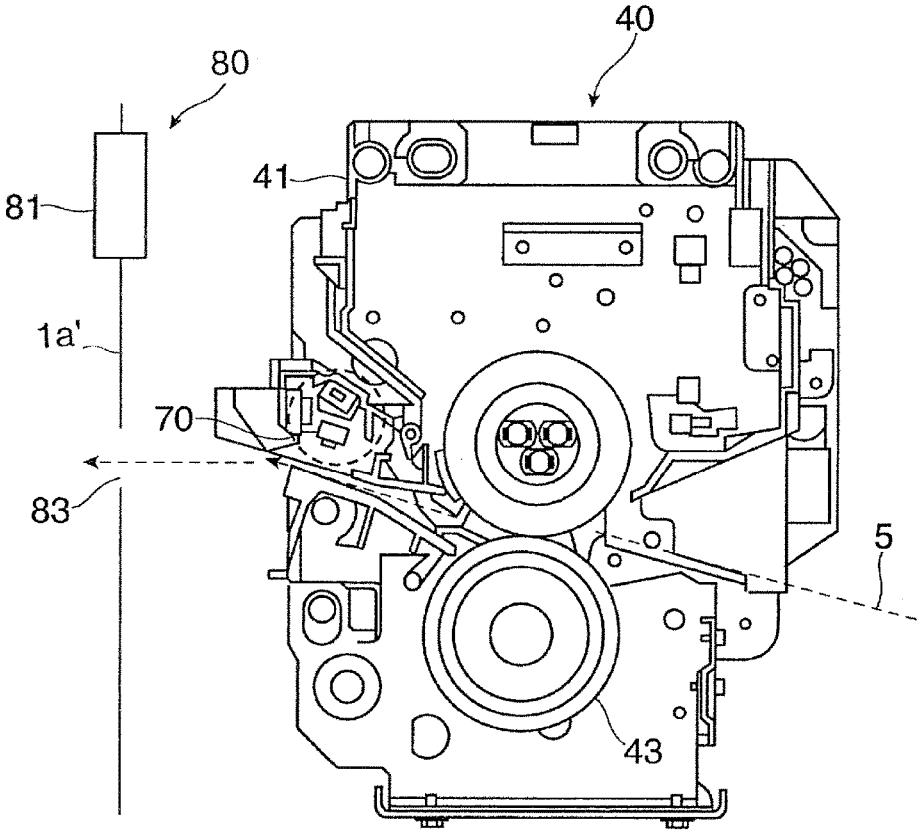
FIG. 9 is a diagram illustrating a principal portion of the fixing device according to the present exemplary embodiment.

More specifically, as illustrated in FIG. 9, the image forming apparatus 1 includes a discharge device 80 that suppresses an increase in the interior temperature of the apparatus body 1*a* by discharging heat emitted by the fixing device 40 and the like together with the air surrounding the fixing device 40 to the outside of the apparatus body 1*a*. Note that a reference numeral 83 denotes the ejection port for the recording sheets 5.

The discharge device 80 includes an exhaust fan 81 that is attached to a side wall 1*a*' of the apparatus body 1*a* of the image forming apparatus 1 so as to be located at a position corresponding to an upper portion of the fixing device 40. The exhaust fan 81 draws in the air surrounding the fixing device 40 and the like and discharges the air to the outside via an exhaust port 82 that is formed in the side wall 1*a*' of the apparatus body 1*a* of the image forming apparatus 1. In this case, the exhaust fan 81 is disposed in such a manner that the air that is drawn in from the vicinity of the heating roller 42 of the fixing device 40 passes through a region of the infrared sensor 70. Thus, as a result of the air in the vicinity of the fixing device 40 being discharged to the outside by the exhaust fan 81 being driven, the air whose temperature has been increased as a result of being heated by the heating roller 42 passes through the region of the infrared sensor 70 such that the infrared sensor 70 is heated.

<Operation of Fixing Device>

The fixing device 40 according to the present exemplary embodiment fixes an unfixed image onto one of the recording sheets 5 in the following manner.

As described above, once the image forming apparatus 1 has received command information of a request for a monochromatic image forming operation (printing) from a user interface, a printer driver, or the like, which is not illustrated, the image forming device 10, the transfer device 20, the fixing device 40, and the like are activated.

Figure 10:
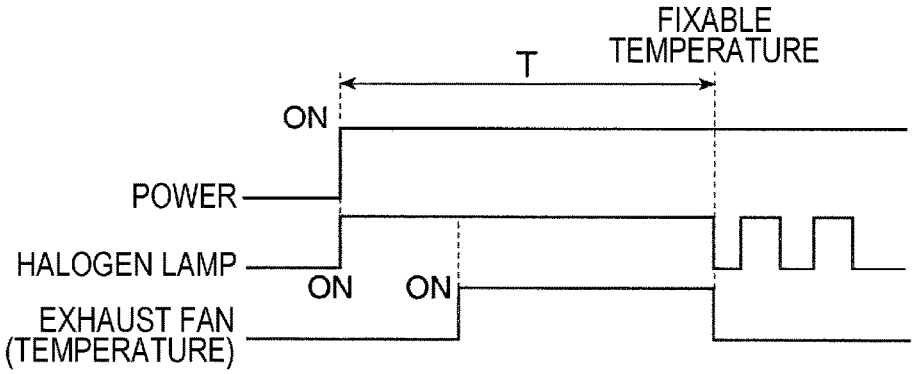
FIG. 10 is a timing chart illustrating an operation of the fixing device according to the present exemplary embodiment.

Once the fixing device 40 has received command information of a request for an image forming operation (printing), as illustrated in FIG. 10, the fixing device 40 changes from a standby state to a state in which a principal portion of the fixing device 40 is switched on and starts energization of the halogen lamps 50 of the heating roller 42 such that the heating roller 42 is heated by the halogen lamps 50. Note that, in this state, the heating roller 42 is not rotating, and the pressure roller 43 is spaced away from the heating roller 42.

Figure 11:
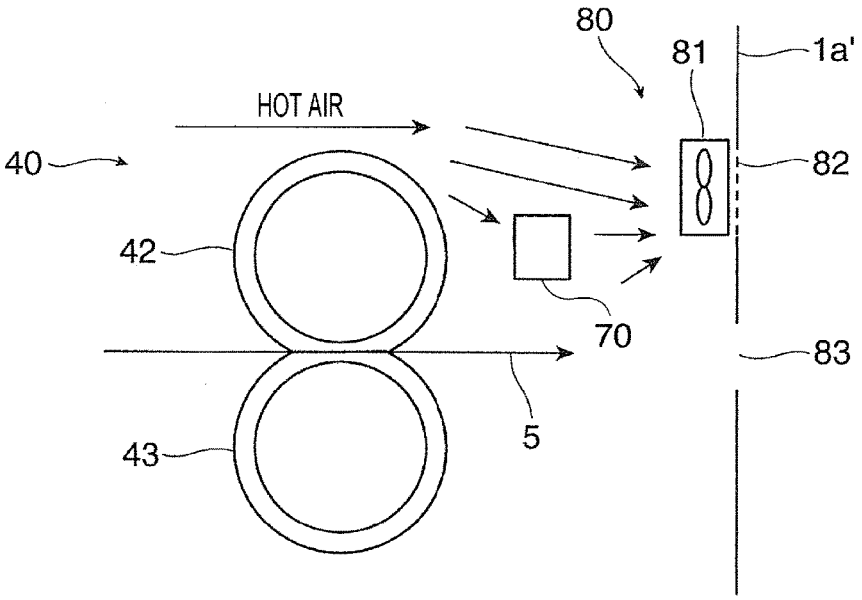
FIG. 11 is a schematic diagram illustrating the operation of the fixing device according to the present exemplary embodiment.

After that, the control device 100 detects the surface temperature of the heating roller 42 of the fixing device 40 by using the temperature sensor 51, and when the surface temperature of the heating roller 42 is equal to or greater than a predetermined driving-start threshold temperature (e.g., about 70° C.), the control device 100 drives the exhaust fan 81. Then, as illustrated in FIG. 11, the air surrounding the fixing device 40 is drawn in by the exhaust fan 81 and is discharged to the outside of the apparatus body 1*a* of the image forming apparatus 1. A portion of the air surrounding the fixing device 40 passes through the infrared sensor 70, and the infrared sensor 70 is heated by the air having a temperature that has been increased as a result of being heated by the heating roller 42 of the fixing device 40.

As described above, since the exhaust fan 81 is driven when the surface temperature of the heating roller 42 is equal to or greater than the predetermined driving-start threshold temperature, the air that passes through the heating roller 42 is also heated to a temperature substantially equal to the surface temperature of the heating roller 42. Consequently, by driving the exhaust fan 81, the air heated by the heat emitted by the heating roller 42 of the fixing device 40 is caused to pass through the region of the infrared sensor 70. As a result, the infrared sensor 70 is heated, and the temperature of the infrared sensor 70 is increased.

Figure 12:
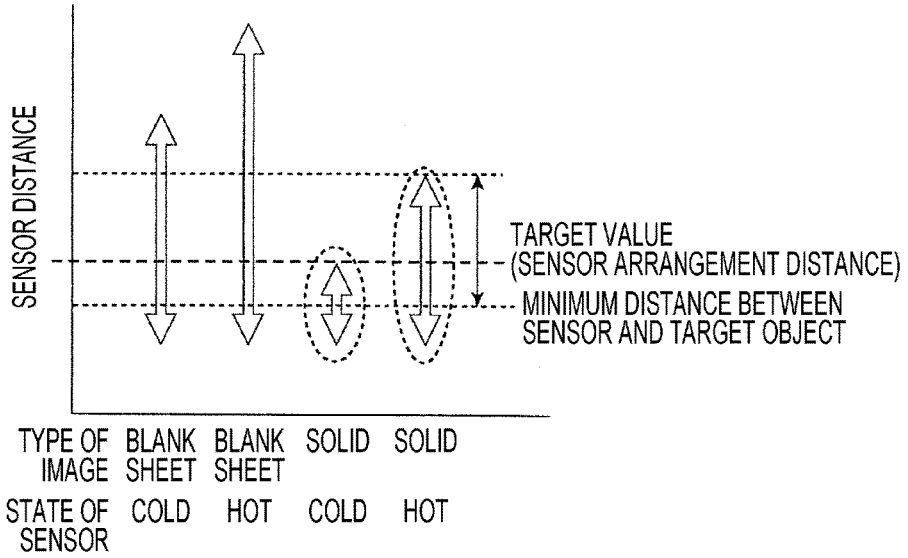
FIG. 12 is a graph representing the characteristics of the infrared sensor included in the fixing device according to the present exemplary embodiment.

As illustrated in FIG. 10, the driving of the exhaust fan 81 is discontinued once the surface temperature of the heating roller 42 has reached a predetermined fixable temperature. The energization of the halogen lamps 50 is on-off-controlled in such a manner that the surface temperature of the heating roller 42 is maintained at the predetermined fixable temperature. Note that, as illustrated in FIG. 3, the heating roller 42 of the fixing device 40 includes the heat-resistant elastic body layer 48 coating the surface of the core bar 47 in such a manner as to have a large thickness, and thus, the heating roller 42 has a relatively large heat capacity. Accordingly, it takes a certain amount of time (e.g., about two to three minutes) for the surface temperature of the heating roller 42 to reach the fixable temperature after the energization of the halogen lamps 50 has been started. Therefore, by heating the infrared sensor 70 by using the air blown by the exhaust fan 81 before the fixing device 40 starts fixing a toner image onto one of the recording sheet 5, as illustrated in FIG. 12, the infrared sensor 70 is heated to a temperature at which the infrared sensor 70 is capable of consistently detecting the recording sheet 5 even if a solid image has been fixed to the recording sheet 5.

Accordingly, even in the case where the fixing device 40 is in the low-temperature state, in which the temperature of the infrared sensor 70 is approximately equal to the environmental temperature and is lower than the predetermined threshold temperature, in, for example, an early morning in winter when the image forming apparatus 1 has not been switched on or when the image forming apparatus 1 has not operated for a long period of time, once the image forming apparatus 1 has received command information of a request for a monochromatic image forming operation (printing), energization of the halogen lamps 50 of the heating roller 42 of the fixing device 40 is performed, and the heating roller 42 is heated by the halogen lamps 50. Then, when the surface temperature of the heating roller 42 of the fixing device 40 reaches the predetermined driving-start threshold temperature or greater, the exhaust fan 81 is driven, and the infrared sensor 70 is heated by the air flow formed by the exhaust fan 81.

After that, the fixing device 40 starts a fixing operation, and when one of the recording sheets 5 that has undergone a heating and fixing treatments performed by the fixing device 40 passes under the infrared sensor 70, the recording sheet 5 is detected by the infrared sensor 70. In this case, since the infrared sensor 70 has been heated by the air flow formed by the exhaust fan 81, even if an image that is formed on the recording sheet 5 is an image, such as a solid image, that has a large area ratio and that is likely to absorb infrared rays, the distance in which the infrared sensor 70 is capable of detecting the recording sheet 5 is large as illustrated in FIG. 12 because the temperature of the infrared sensor 70 has been increased such that the sensitivity of the infrared sensor 70 has been improved as illustrated in FIG. 6C.

Figure 13:
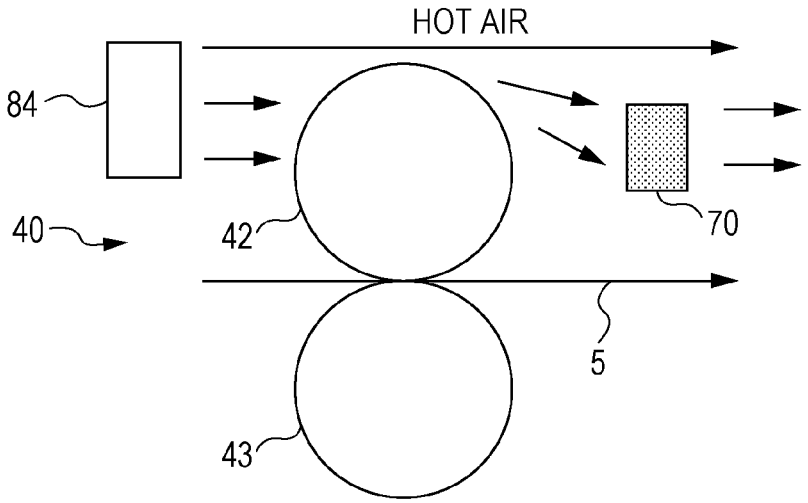
FIG. 13 is a diagram illustrating a modification of the fixing device according to the present exemplary embodiment.

In the present exemplary embodiment, although a case has been described in which an air-blowing unit is positioned downstream from a fixing unit in the direction in which a recording medium is to be transported, the present invention is not limited to the exemplary embodiment, and as illustrated in FIG. 13, the air-blowing unit may be formed of an air-blowing fan 84 that blows air toward the fixing unit from a position upstream from a detector in the transport direction of the recording medium. In this case, the temperature of the air that reaches the detector via the fixing unit is higher compared with the case where the air-blowing unit is not formed of an air-blowing fan that blows air toward the fixing unit from a position upstream from the detector in the transport direction of the recording medium.

In addition, in the present exemplary embodiment, although an image forming apparatus that forms a monochromatic image has been described as the image forming apparatus 1, it is obvious that the present invention may also be applied to a full-color image forming apparatus that forms toner images of four colors of yellow (Y), magenta (M), cyan (C), and black (K).

Furthermore, although it is desirable that the exhaust fan 81 be attached to a side surface of the apparatus body 1*a*, which is a surface perpendicular to the transport direction of the recording sheets 5, the effects of the present invention may be provided even in the case where the exhaust fan 81 is attached to the front surface or the rear surface of the apparatus body 1*a*.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing unit configured to heat and fix an unfixed image held on a recording medium onto the recording medium;

a detector that is disposed at a position downstream from the fixing unit in a direction in which the recording medium is transported and that is configured to detect the recording medium by detecting thermal energy emitted by the recording medium; and a heating unit configured to heat the detector;

wherein the heating unit is formed of an air-blowing unit that is configured to send air heated by the fixing unit to the detector.

2. The fixing device according to claim 1, wherein the heating unit is configured to heat the detector when the fixing unit starts a fixing operation.

3. An image forming apparatus comprising:

an image forming unit configured to form an image on a recording medium; and a fixing device configured to heat and fix an unfixed image formed on the recording medium by the image forming unit onto the recording medium, wherein the fixing device according to claim 2 is used as the fixing device.

4. The fixing device according to claim 1, wherein the air-blowing unit comprises an exhaust fan configured to discharge heat from the fixing unit to the outside such that the heat passes through the detector.

5. The fixing device according to claim 4, wherein the exhaust fan is positioned downstream from the detector in the direction, in which the recording medium is transported, and is provided on a surface perpendicular to the direction, in which the recording medium is transported.

6. An image forming apparatus comprising:

an image forming unit configured to form an image on a recording medium; and a fixing device configured to heat and fix an unfixed image formed on the recording medium by the image forming unit onto the recording medium, wherein the fixing device according to claim 5 is used as the fixing device.

7. An image forming apparatus comprising:

an image forming unit configured to form an image on a recording medium; and a fixing device configured to heat and fix an unfixed image formed on the recording medium by the image forming unit onto the recording medium, wherein the fixing device according to claim 4 is used as the fixing device.

8. The fixing device according to claim 1, wherein the air-blowing unit comprises an air-blowing fan configured to blow air toward the fixing unit from a position upstream from the detector in the direction, in which the recording medium is transported.

9. An image forming apparatus comprising:

an image forming unit configured to form an image on a recording medium; and a fixing device configured to heat and fixe an unfixed image formed on the recording medium by the image forming unit onto the recording medium, wherein the fixing device according to claim 8 is used as the fixing device.

10. An image forming apparatus comprising:

an image forming unit configured to form an image on a recording medium; and a fixing device configured to heat and fix an unfixed image formed on the recording medium by the image forming unit onto the recording medium, wherein the fixing device according to claim 1 is used as the fixing device.

* * * * *